US011432688B2

(12) United States Patent
Yamashita

(10) Patent No.: US 11,432,688 B2
(45) Date of Patent: Sep. 6, 2022

(54) WET-SHEET LAMINATED BODY, WET-SHEET PACKAGE, AND PRODUCTION METHOD FOR WET-SHEET LAMINATED BODY

(71) Applicant: DAIO PAPER CORPORATION, Shikokuchuo (JP)

(72) Inventor: Shoko Yamashita, Shikokuchuo (JP)

(73) Assignee: DAIO PAPER CORPORATION, Shikokuchuo (JP)

( * ) Notice: Subject to any disclaimer, the term of this patent is extended or adjusted under 35 U.S.C. 154(b) by 0 days.

(21) Appl. No.: 17/280,596

(22) PCT Filed: Sep. 17, 2019

(86) PCT No.: PCT/JP2019/036302

§ 371 (c)(1),
(2) Date: Mar. 26, 2021

(87) PCT Pub. No.: WO2020/066733

PCT Pub. Date: Apr. 2, 2020

(65) Prior Publication Data

US 2021/0393091 A1 Dec. 23, 2021

(30) Foreign Application Priority Data

Sep. 28, 2018 (JP) ..... JP2018-183631

(51) Int. Cl.
*A47L 13/51* (2006.01)
*A47K 10/42* (2006.01)
(Continued)

(52) U.S. Cl.
CPC .... *A47K 10/421* (2013.01); *A47K 2010/3266* (2013.01); *A47K 2010/428* (2013.01); *A47L 13/17* (2013.01); *A47L 13/51* (2013.01)

(58) Field of Classification Search
CPC ..... A47K 10/421
(Continued)

(56) References Cited

U.S. PATENT DOCUMENTS 6,270,878 B1 8/2001 Wegele et al.
2016/0031632 A1* 2/2016 Ripberger ..... B65D 83/0835 221/48
2016/0113450 A1* 4/2016 Yamada ..... B65D 75/5894 221/53

FOREIGN PATENT DOCUMENTS

CN 1352547 A 6/2002
CN 1663516 A 9/2005
(Continued)

OTHER PUBLICATIONS

Chinese Office action dated Nov. 30, 2021, in corresponding Chinese Application No. 201980058129.9, 20 pages including English translation.
International Search Report (ISR) (and English translation thereof) dated Nov. 5, 2019 issued in International Application No. PCT/JP2019/036302.
(Continued)

*Primary Examiner* — Gene O Crawford
*Assistant Examiner* — Ayodeji T Ojofeitimi
(74) *Attorney, Agent, or Firm* — Maier & Maier, PLLC

(57) ABSTRACT

A wet-sheet laminated body includes multiple folded wet sheets that are stacked such that an end portion of one wet sheet among the wet sheets is sandwiched by a folded-back portion of another wet sheet among the wet sheets. Each of the wet sheets includes a base material sheet impregnated with a chemical solution such that impregnated portions that are impregnated with the chemical solution and non-impregnated portions that are not impregnated with the chemical solution are provided. The impregnated portions and the nonimpregnated portions are formed in a stripe pattern in which the impregnated portions and the non-impregnated portions are alternately arranged.

8 Claims, 5 Drawing Sheets

(51) Int. Cl.
*A47K 10/32* (2006.01)
*A47L 13/17* (2006.01)

(58) Field of Classification Search
USPC ..... 221/33–63
See application file for complete search history.

(56) References Cited

FOREIGN PATENT DOCUMENTS

| | | | |
|---|---|---|---|
| EP | 1189588 | B1 | 5/2009 |
| GB | 2558580 | A | 7/2018 |
| JP | 2003500168 | A | 1/2003 |
| JP | 2005245862 | A | 9/2005 |
| JP | 2014068859 | A | 4/2014 |
| JP | 6188234 | B2 | 8/2017 |

OTHER PUBLICATIONS

Japanese Office Action (and English language translation thereof) dated Mar. 9, 2021 issued in Japanese Application No. 2018-183631.
Written Opinion dated Nov. 5, 2019 issued in International Application No. PCT/JP2019/036302.
International Preliminary Report on Patentability (IPRP) (and English language translation thereof) dated Mar. 23, 2021 issued in International Application No. PCT/JP2019/036302.
Extended European Search Report dated May 19, 2022, in connection with corresponding European Application No. 19867246.1; 7 pages.
Office Action dated Jun. 27, 2022 in corresponding Russian Application No. 202110807; 18 pages including English-language translation.

* cited by examiner

WET-SHEET LAMINATED BODY, WET-SHEET PACKAGE, AND PRODUCTION METHOD FOR WET-SHEET LAMINATED BODY

The present invention relates to a wet-sheet laminated body, a wet-sheet package, and a production method for wet-sheet laminated body.

BACKGROUND ART

There has been conventionally known a so-called pop-up type wet-sheet laminated body that enables using the next sheet continuously by lifting the next sheet when the uppermost sheet is pulled out, in order to make the laminated body easy to use when the laminated body is made by stacking multiple home wet sheets such as wet tissues, toilet cleaners, and kitchen cleaners.

As such a pop-up type wet-sheet laminated body, for example, there is known a wet-sheet laminated body formed by stacking sheets to partially overlap, each of the sheets being folded in a Z form (for example, see JP 6188234 B).

SUMMARY OF INVENTION

The pop-up type wet-sheet laminated body is used in such a manner that the wet-sheet laminated body is contained in a predetermined package and wet sheets are taken out one by one through a takeout port provided in the package.

However, in conventional wet-sheet laminated bodies, upon taking out one wet sheet through the takeout port, the next wet sheet was frequently taken out in the form of a string of the wet sheets.

In this respect, in order to prevent this, the wet-sheet laminated body described in JP 6188234 B intends to suppress the unnecessary jumping out of the next wet sheet when one wet sheet is taken out through a takeout port, by lowering the impregnation rate of the chemical solution for the overlapping portions of ends of upper and lower wet sheets. However, the effect was not always sufficient.

An object of the present invention is to provide a wet-sheet laminated body, a wet-sheet package, and a production method for the wet-sheet laminated body which can reduce the possibility that a string of wet sheets is taken out when a wet sheet is taken out through a takeout port of the package.

One aspect of the invention is a wet-sheet laminated body including multiple folded wet sheets that are stacked such that an end portion of one wet sheet among the wet sheets is sandwiched by a folded-back portion of another wet sheet among the wet sheets. Each, of the wet sheets includes a base material sheet impregnated with a chemical solution such that multiple impregnated portions that are impregnated with the chemical solution and multiple non-impregnated portions that are not impregnated with the chemical solution are provided. The impregnated portions and the non-impregnated portions are formed in a stripe pattern in which the multiple impregnated portions and the multiple nonimpregnated portions are alternately arranged. With this structure, the wet-sheet laminated body that can reduce the possibility that a string of wet sheets will be taken out when a wet sheet is taken out through a takeout port of a package.

The impregnated portions and the non-impregnated portions can be arranged at shifted positions in a plan view in the one wet sheet and in the another wet sheet, which is arranged immediately above the one wet sheet. With this structure, the wet-sheet laminated body that can further reduce the possibility that a string of wet sheets will be taken out when a wet sheet is taken out through a takeout port of a package.

The impregnated portions and the nonimpregnated portions can be arranged in a staggered manner in the one wet sheet and in the another wet sheet, which is arranged immediately above the one wet sheet. With this structure, the wet-sheet laminated body that can further reduce the possibility that a string of wet sheets will be taken out when a wet sheet is taken out through a takeout port of a package.

The stripe pattern of the impregnated portions and the non-impregnated portions can be parallel to a fold of the wet sheet in a plan view of the wet-sheet laminated body. With this structure, the wet sheet laminated body can be produced easily.

The wet sheets can be formed in a rectangular shape, and each of the wet sheets can be folded such that the wet sheet is folded back to a first surface side thereof at a first fold that is substantially parallel to a first edge of the wet sheet, the wet sheet is folded back to a second surface side thereof at a second fold that is formed between the first fold and the first edge and is substantially parallel to the first edge, the wet sheet is folded back to the second surface side so as to wrap around an outer circumference of the first fold at a third fold that is formed between the second fold and the first edge and is substantially parallel to the first edge. In addition, the multiple wet sheets can be stacked such that the second surface sides thereof are directed upward in a portion between the first fold and a second edge facing the first edge. Moreover, the another wet sheet can be located above the one wet sheet in such a way that the second edge of the one wet sheet is sandwiched between a portion between the first fold and the second fold of the another wet sheet and a portion between the first fold and the second edge facing of the another wet sheet.

With this structure, the wet-sheet laminated body that can further reduce the possibility that a string of wet sheets will be taken out when a wet sheet is taken out through a takeout port of a package.

Another aspect of the invention is a wet-sheet package which includes a takeout port and which contains the wet-sheet laminated body described above This wet-sheet package can reduce the possibility that a string of wet sets will be taken out when a wet sheet is taken out through a takeout port of the package.

A further aspect of the invention is a production method for a wet-sheet laminated body that includes:

folding a base material sheet, impregnating the folded base material sheet with a chemical solution to form multiple impregnated portions impregnated with the chemical solution and multiple non-impregnated portions not impregnated with the chemical solution in a stripe pattern in which the impregnated portions and the non-impregnated portions are alternately arranged, and stacking multiple base material sheets each having the multiple impregnated portions impregnated with the chemical solution and the multiple non-impregnated portions not impregnated with the chemical solution. With this method, a wet-sheet laminated body can be produced that can reduce the possibility that a string of wet sheets will be taken out when a wet sheet is taken out through a takeout port of a package.

A further aspect of the invention is a production method for a wet-sheet laminated body that includes:

impregnating a base material sheet with a chemical solution to form multiple impregnated portions impregnated with the chemical solution and multiple non-impregnated portions not impregnated with the chemical solution in a stripe pattern in which the impregnated portions and the non-impregnated portions are alternately arranged, folding the base material sheet impregnated with the chemical solution, and stacking base material sheets each having the multiple impregnated portions impregnated with the chemical solution and the multiple non-impregnated portions not impregnated with the chemical solution. With this method, a wet-sheet laminated body can be produced that can reduce the possibility that a string of wet sheets will be taken out when a wet sheet is taken out through a takeout port of a package.

DETAILED DESCRIPTION

Hereinafter, a wet-sheet laminated body 110 and a wet-sheet package 100 having the wet-sheet laminated body 110 contained in a package 120 as an embodiment of the present invention is described with reference to FIG. 1A to FIG. 5. However, the scope of the invention is not limited to the illustrated examples.

Figure 1A:
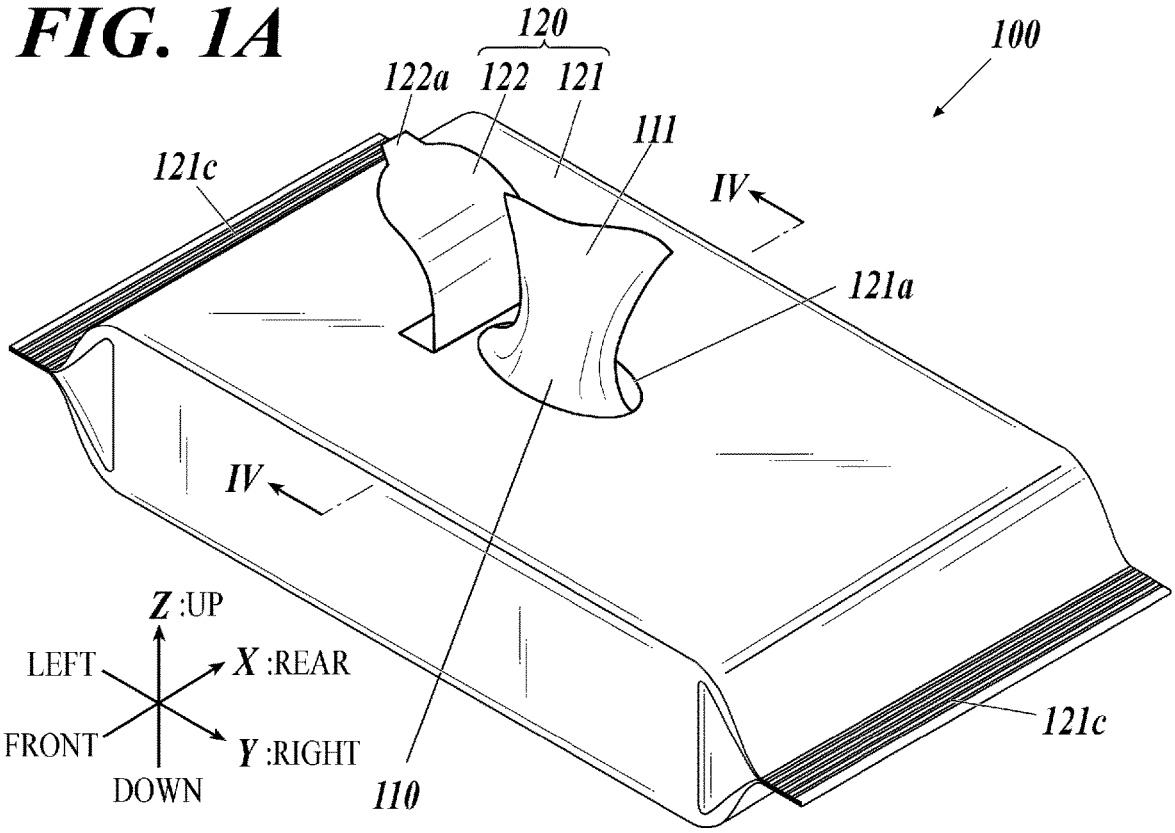
FIG. 1A is a perspective view of a wet-sheet package according to an embodiment, viewed diagonally from above.

In the following description, front-rear direction, left-right direction, and up-down direction, and an X-axis, Y-axis, and Z-axis are defined as shown in FIG. 1A. That is, in the wet-sheet package 100, the side on which a takeout port 121*a* is formed in a bag body 121 and the side opposite thereto are respectively referred to as up and down, the side on which one of the long edges in a plan view of the wet-sheet package 100 is located and the side opposite thereto are respectively referred to as rear and front, the right side when seen from the front side is referred to as right, and the left side when seen from the front side is referred to as left. The axis along the front-rear direction is referred to as the X axis, the axis along the left-right direction is referred to as the Y axis, and the axis along the up-down direction is referred to as the Z axis.

Configuration in Embodiment

As shown in FIG. 1A, the wet-sheet package 100 according to the embodiment is obtained by containing, in the package 120, the wet-sheet laminated body 110 that is formed by stacking multiple wet sheets 111.

{Wet-Sheet Laminated Body}

In the wet-sheet laminated body 110, the wet sheets 111 are folded by a predetermined folding manner and then stacked, and when the uppermost wet sheet 111 is lifted, the next wet sheet 111 is also lifted to be able to be continuously used, in a so-called pop-up manner.

(Configuration of Wet Sheet)

The wet sheet 111 is not particularly limited, and any arbitrary sheet formed by impregnating a base material sheet with a chemical solution such as a general rectangular wet sheet, a toilet cleaner, and a kitchen cleaner can be used.

To be specific, the base material sheet is preferably a nonwoven fabric that is produced with a predetermined fiber as a fiber material by any known technique such as spun-lace, air-through, air-laid, point-bond, spun-bond and needle-punch in the case of a wet tissue, for example. The predetermined fiber includes, for example, cellulosic fibers such as rayon, lyocell, tencel, and cotton, polyolefin fibers such as polyethylene, polypropylene, and polyvinyl alcohol, polyester fibers such as polyethylene terephthalate, and polybutylene terephthalate, and polyamide fibers such as nylon. These types of fibers may be used alone or in combination of two types or more.

A preferred base material sheet has the basis weight (metsuke) of 30 to 100 gsm and the size of 100 to 200 mm in the MD direction (paper traveling direction on the paper machine) and 100 to 200 mm in the CD direction (direction orthogonal to the paper traveling direction on the paper machine) in the case of a wet tissue, for example. The basis weight indicates a basis weight which was measured in accordance with JIS P 8124:2011.

Though the base material sheet can be impregnated with an arbitrary chemical solution according to the usage of wet sheets 111, a preferred chemical solution contains purified water, a preservative, a pH adjuster, and the like in the case of a wet tissue, for example.

In this case, a preferable chemical solution impregnation rate is between 100 mass % and 400 mass % inclusive. The chemical solution impregnation rate indicates the rate obtained by measuring the mass of the base material sheet of a wet sheet 111 before impregnation with the chemical solution and the mass of the chemical solution used for the impregnation, and calculating the rate of the mass of the chemical solution used for the impregnation to the mass of the base material sheet before the impregnation with the chemical solution.

The pattern of impregnation of the base material sheet with the chemical solution in the wet sheet 111 will be described later.

(Folding Method of Wet Sheet)

The wet-sheet laminated body 110 is formed by folding each of multiple rectangular wet sheets 111 and then stacking the multiple wet sheets 111. The folding manner of each of the wet sheets 111 will be first described with reference to FIG. 2.

First, the wet sheet 111 is folded back to one surface side of the wet sheet 111 (the one surface is referred to as a first surface 111*c*, the surface opposite to the first surface 111*c* is referred to as a second surface 111*d*) at a first fold 111*e* which is substantially parallel to one edge of the wet sheet 111 (the one edge is referred to as a first edge 111*a*, the edge facing the first edge 111*a* is referred to as a second edge 111*b*).

The wet sheet 111 is folded back to the second surface 111*d* side of the wet sheet 111 at a second fold 111*f* which is formed between the first fold 111*e* and the first edge 111*a* and substantially parallel to the first edge 111*a* and the second edge 111*b*.

The wet sheet 111 is folded back to the second surface 111*d* side so as to wrap around the outer circumference of the first fold 111*e* at a third fold 111*g* which is formed between the second fold 111*f* and the first edge 111*a* and substantially parallel to the first edge 111*a* and the second edge 111*b*.

The wet sheet 111 is folded back to the first surface 111*c* side at a fourth fold 111*h* which is formed between the third fold 111*g* and the first edge 111*a* and substantially parallel to the first edge 111*a* and the second edge 111*b*.

As for the fourth fold 111*h*, folding back to the one surface 111*c* side as descried above is desirable. However, contrary to the above, folding to the second surface 111*d* side is also possible.

The portion between the second edge 111*b* and the first fold 111*e* is referred to as a main portion 111*i*. The portion between the first fold 111*e* and the second fold 111*f* is referred to as a first folded-back portion 111*j*. The portion between the second fold 111*f* and the third fold 111*g* is referred to as a second folded-back portion 111*k*. The portion between the third fold 111*g* and the fourth fold 111*h* is referred to as a third folded-back portion 111*l*. The portion between the fourth fold 111*h* and the first edge 111*a* is referred to as a fourth folded-back portion 111*m*.

In this case, it is preferable that the width (the length in the direction orthogonal to the first edge 111*a* and the second edge 111*b*) of the main portion 111*i* is 40 to 45% of the entire width of the wet sheet 111, the width of the first folded-back portion 111*j* is 14 to 20% of the entire width of the wet sheet 111, the width of the second folded-back portion 111*k* is 14 to 20% of the entire width of the wet sheet 111, the width of the third folded-back portion 111*l* is 17 to 23% of the entire width of the wet sheet 111, and the width of the fourth folded-back portion 111*m* is 1 to 5% of the entire width of the wet sheet 111.

The width of the second folded-back portion 111*k* needs to be larger than or equal to the width of the first folded-back portion 111*j* in order to form the third fold 111*g* so as to wrap around the outer circumference of the first fold 111*e*.

It is preferable that the fourth folded-back portion 111*m* is formed to overlap with the first folded-back portion 111*j* and the second folded-back portion 111*k* in the up-down direction.

Though it is preferable to have the fourth fold 111*h* and the fourth folded-back portion 111*m* in the wet sheet 111, the fourth fold 111*h* and the fourth folded-back portion 111*m* are not essential. The fourth fold 111*h* and the fourth folded-back portion 111*m* may not be provided, and the portion to the first edge 111*a* may be the third folded-back portion 111*l*.

It is desirable for forming the wet-sheet laminated body 110 compact that the wet-sheet laminated body 110 is formed such that the first edge 111*a* and the second edge 111*b* are short edges of the rectangular wet sheet 111, the first fold 111*e*, the second fold 111*f*, the third fold 111*g* and the fourth fold 111*h* are formed to be substantially parallel to the short edges of wet sheet 111, and the long direction of the wet sheet 111 which is not folded becomes the short direction in a plan view of the wet-sheet laminated body 110 by the wet sheet 111 being folded back in the long direction.

However, the configuration is not limited to this, and the wet-sheet laminated body 110 can be formed such that the first fold 111*e*, the second fold 111*f*, the third fold 111*g* and the fourth fold 111*h* are formed substantially parallel to the long edge of the wet sheet 111 and the wet sheet 111 is folded back in the short direction, though this configuration is not desirable for forming the wet-sheet laminated body 110 compact.

(Impregnation Pattern of Chemical Solution)

Figure 2:
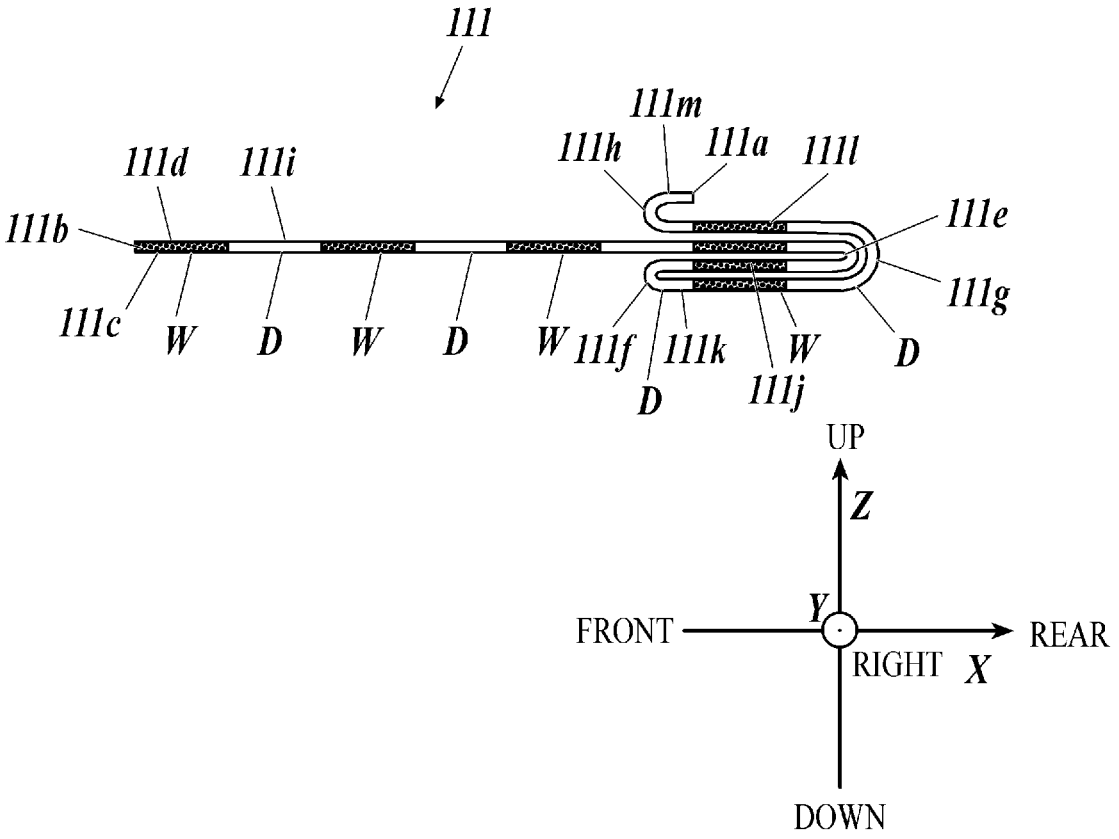
FIG. 2 is a lateral view of a folded wet sheet according to the embodiment. The interval between folded sheets is shown to be larger than the real interval.
Figure 3:
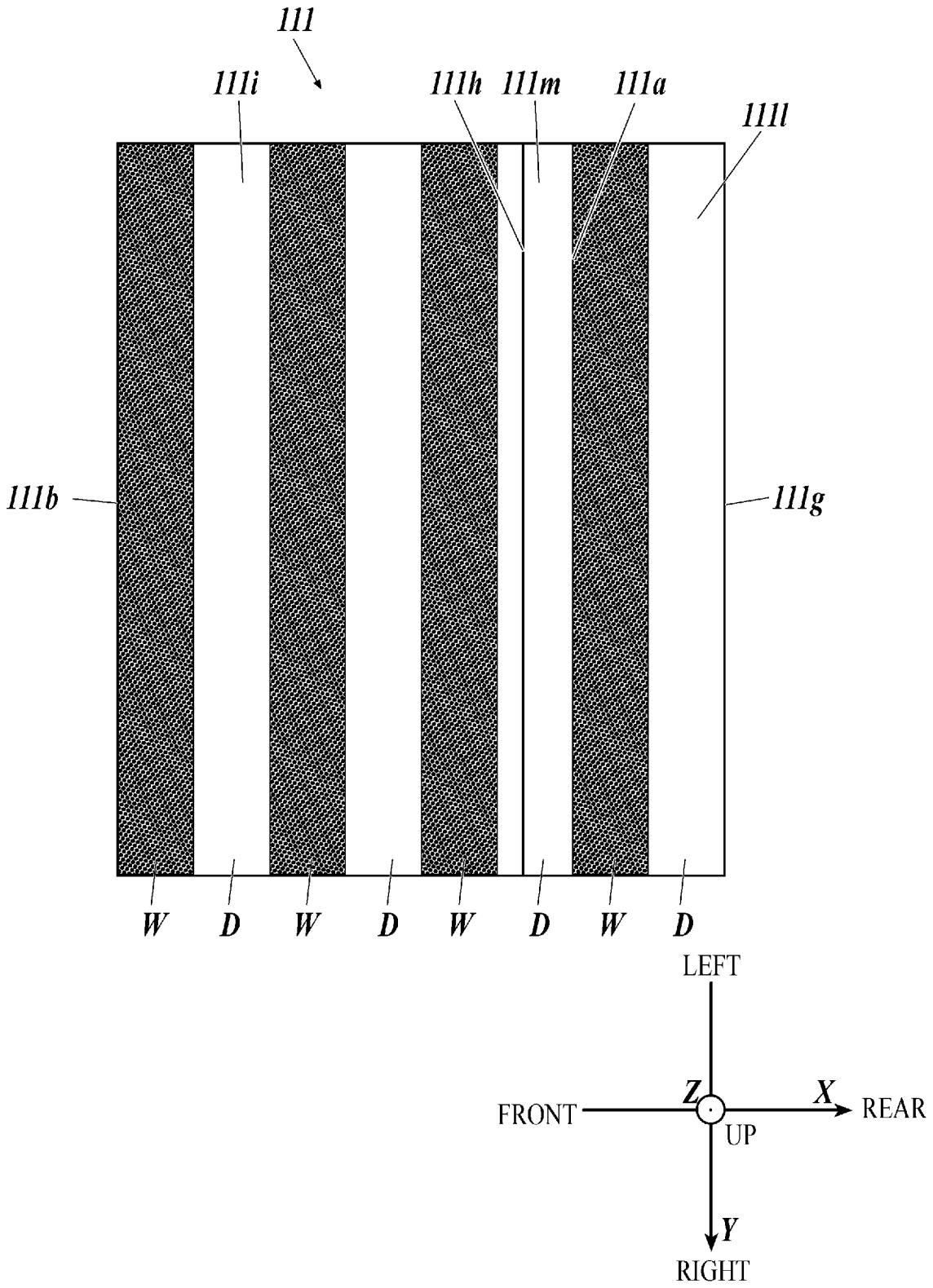
FIG. 3 is a plan view of the folded wet sheet according to the embodiment.

As shown in FIGS. 2 and 3, each of the wet sheets 111 is impregnated with a chemical solution in a stripe pattern in which multiple impregnated portions W impregnated with the chemical solution and multiple non-impregnated portions D not impregnated with the chemical solution are alternately arranged in a plan view in a state in which the wet sheet 111 is folded.

The number of stripes each including the impregnated portion W and the non-impregnated portion D is preferably 2 to 20 in a plan view of the folded wet sheet 111, and more preferably 4 to 10. In the unfolded wet sheet 111, the number of stripes is preferably 4 to 30, and more preferably 10 to 20.

The non-impregnated portion D not only includes the portion which does not contain the chemical solution at all, but also includes the portion which slightly contains the chemical solution due to the influence of the impregnated portion(s) W of the wet sheet(s) 111 around the non-impregnated portion D after the wet sheets 111 were stacked.

To be specific, as shown in FIG. 3, the wet sheet 111 is impregnated with the chemical solution such that the stripe pattern is parallel to the folds formed in the wet sheet 111 and the impregnated potions W and the non-impregnated portions D are alternately arranged in the direction (X direction in FIG. 3) orthogonal to the folds formed in the wet sheet 111.

The impregnated portion W is preferably formed to have the width of 2 to 40 mm in the direction (X direction in FIG. 3) orthogonal to the folds formed in the base material sheet, and more preferably formed to have the width of 5 to 20 mm.

The non-impregnated portion D is preferably formed to have the width of 2 to 40 mm in the direction (X direction in FIG. 3) orthogonal to the folds formed in the base material sheet, and more preferably formed to have the width of 5 to 20 mm.

{Stretch of Sheet}

Each of the wet sheets 111 forming the wet-sheet laminated body 110 preferably stretches by 100 mm or less when the force of 1.5 N is applied by the following test method.

The stretch of wet sheet 111 is a value obtained by cutting the main portion 111*i* of the wet sheet 111 impregnated with the chemical solution to have the width of 50 mm in the direction orthogonal to the stripes formed of the impregnated portions W and the non-impregnated portions D, and thereafter measuring the stretch when this cut portion is tensioned by 1.5 N in the direction along the stripes formed of the impregnated portions W and the non-impregnated portions D by using a tensile testing machine (TENSILON RTG1210 manufactured by A&D Company, Limited) with the distance between chucks of 100 mm and the speed of 100 mm/min.

The stretch of wet sheet 111 can be reduced by adding a binder to the base material sheet. When the base material sheet is a spun-lace nonwoven fabric, the stretch of wet sheet 111 can be reduced by raising the water pressure at the time of formation, raising the compressibility, and the like.

(Stacking Method of Sheets)

The wet-sheet laminated body 110 is formed by stacking the multiple wet sheets 111 which were folded as described above and impregnated with the chemical solution such that the second surface 111*d* is directed upward in each main portion 111*i*.

Figure 4:
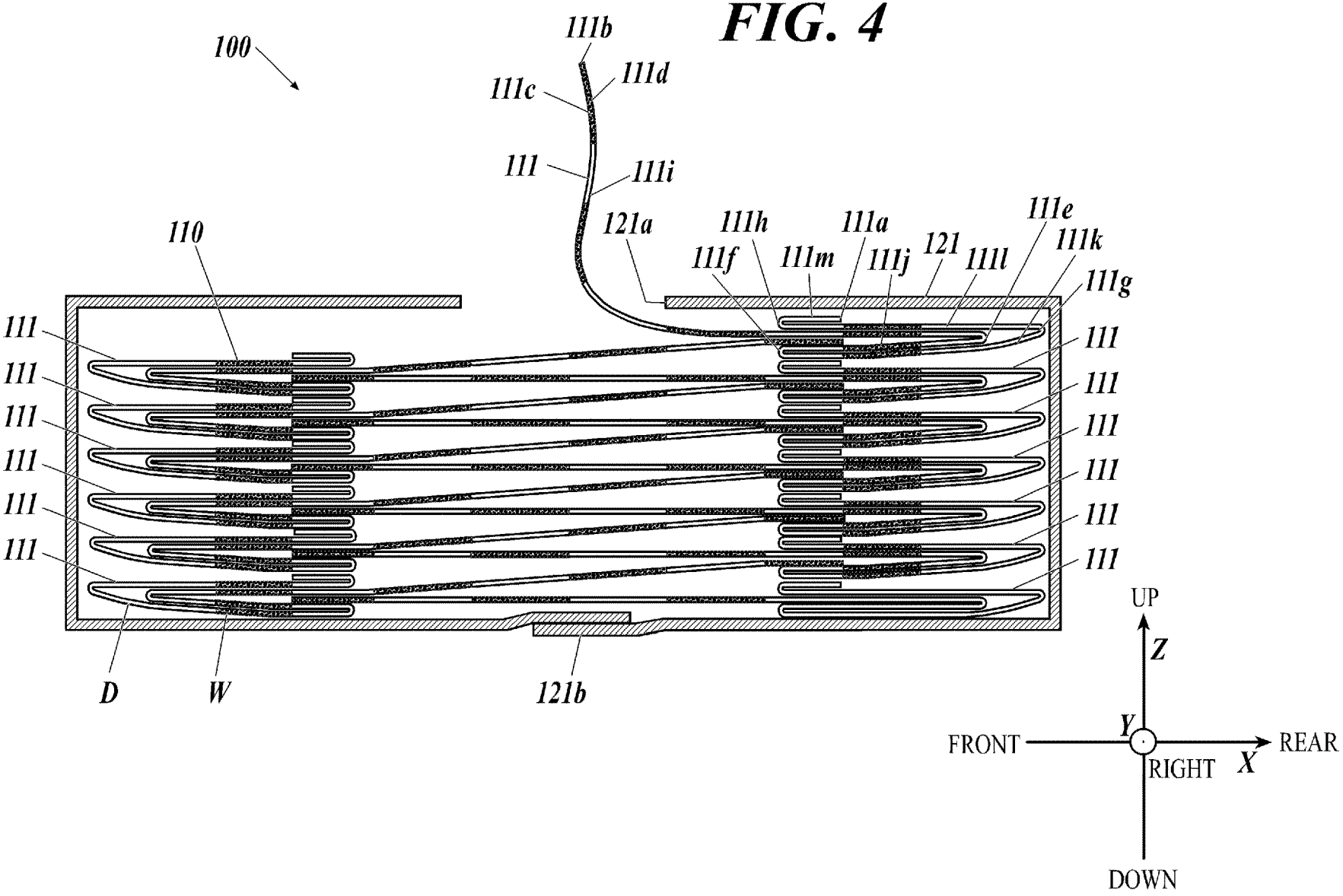
FIG. 4 is a sectional view along the IV-IV portion in FIG. 1A. The interval between folded sheets and interval between stacked sheets are shown to be larger than the real intervals. The number of stacked sheets is shown to be smaller than the real number of stacked sheets.

To be specific, as shown in FIG. 4, the wet-sheet laminated body 110 is formed by alternating stacking the wet sheets 111 arranged with the first edge 111*a* side and the second edge 111*b* side directed to opposite directions.

The portion around the second edge 111*b* in the main portion 111*i* of each of the wet sheets 111 except for the uppermost wet sheet 111 is arranged to be sandwiched between the main portion 111*i* and the first folded-back portion 111*j* of the wet sheet 111 immediately above the wet sheet 111.

In this case, the width of the portion around the second edge 111*b* in the main portion 111*i* of the lower wet sheet 111 which is sandwiched between the main portion 111*i* and the first folded-back portion 111*j* of the wet sheet 111 immediately above the wet sheet 111 is preferably 5 to 35% of the width of the main portion 111*i* of the lower wet sheet 111.

As shown in FIG. 4, it is most preferable that the wet sheets 111 are stacked such that the impregnated portions W in each of the wet sheets 111 do not overlap with the impregnated portions W in the wet sheets 111 located immediately above and below the wet sheet 111 in a plan view and the arrangement is made in a staggered manner.

However, the stacking is not necessarily limited to this. The wet sheets 111 can be stacked such that the impregnated portions W in each of the wet sheets 111 are at substantially same positions in a plan view as the impregnated portions W in the wet sheets 111 located immediately above and below the wet sheet 111. The wet sheets 111 can be stacked such that the impregnated portions W in each of the wet sheets 111 include both of portion(s) overlapping with the impregnated portion(s) W in the wet sheets 111 located immediately above and below the wet sheet 111 and portion(s) not overlapping with the impregnated portion(s) W.

Though not particularly limited, the number of wet sheets 111 to be stacked is preferably 40 to 80.

{Package}

As shown in FIG. 1A, the package 120 is formed by a bag body 121 having a takeout port 121*a* to take out the wet sheet 111 one by one which is formed in the upper surface of the bag body 121, and a lid material 122 which covers the takeout port 121*a* to be openable and closable. As shown in FIG. 4, the package 120 is used by containing the wet-sheet laminated body 110 therein.

Figure 1B:
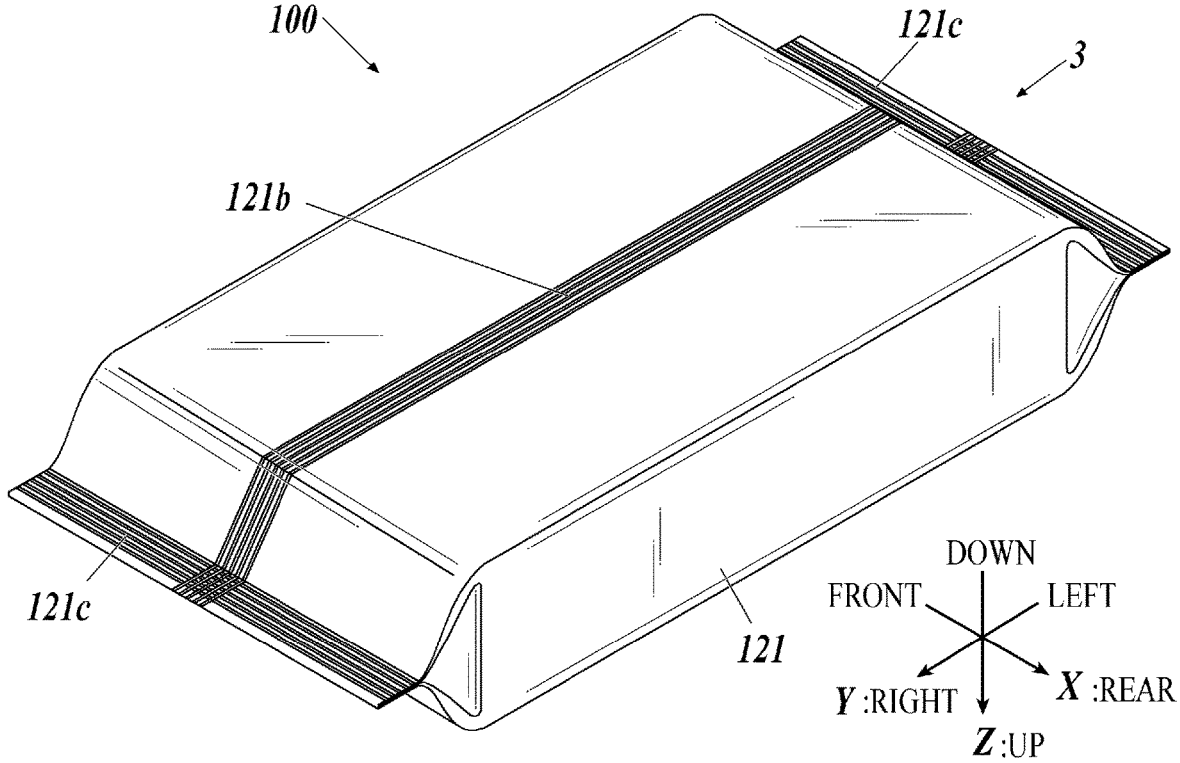
FIG. 1B is a perspective view of the wet-sheet package according to the embodiment, viewed diagonally from below.

FIGS. 1A and 1B and FIG. 4 illustrate a case where the first edge 111*a* and the second edge 111*b* of each of the wet sheets 111 forming the wet-sheet laminated body 110 are substantially parallel to the long direction in a plan view of the package 120.

(Bag Body)

The bag body 121 is formed of a sheet material in a bag shape. As the sheet material, for example, there can be used a single or composite material of a synthetic resin sheet such as polyethylene, polypropylene, polyethylene terephthalate, polyester, polyamide, and polyvinyl chloride, or a composite sheet attaching such a synthetic resin sheet to aluminum foil, paper or the like.

The thickness of the sheet material is preferably 40 to 70 μm.

In the sheet material forming the bag body 121, the portions on the back surface side of the bag body 121 are joined along the long direction of the bag body 121 to form a center seal portion 121*b*, and portions at the ends in the long direction of the bag body 121 are connected to form end seal portions 121*c*, 121*c*.

The size of the bag body 121 is determined according to the size of the wet-sheet laminated body 110 to be contained therein. The bag body 121 preferably has a size that enables containing the wet-sheet laminated body 110 with a slight room left so as to avoid both of the unnecessary increase in size of the package 120 and the difficulty in taking out the wet sheet 111 at the start of use.

(Takeout Port)

Though not particularly limited, the shape of the takeout port 121*a* formed in the upper surface of the bag body 121 is preferably an oval as shown in FIG. 1A, and in order to apply an appropriate resistance to the wet sheet 111 which is pulled out, the size of takeout port 121*a* is preferably 30 to 50 mm in the long direction of the takeout port 121*a* and 10 to 30 mm in the short direction, and more preferably 35 to 45 mm in the long direction and 13 to 18 mm in the short direction.

It is desirable that the long direction is substantially parallel to the direction of each fold of the wet sheets 111 contained inside.

As shown in FIG. 4, it is desirable that the takeout port 121*a* is formed at a position not overlapping with the third folded-back portion 111*l* or the fourth folded-back portion 111*m* of each wet sheet 111 forming the wet-sheet laminated body 110 therein in a plan view, and only the main portion 111*i* of the wet sheet 111 can be seen from the takeout port 121*a* in a plan view.

Thereby, it is possible to prevent the user from nipping the third folded-back portion 111*l* or the fourth folded-back portion 111*m* and pulling out the wet sheet 111.

(Lid Material)

As shown in FIG. 1A, the lid material 122 is configured to cover the takeout port 121*a* to be openable and closable with a sheet piece which is separate from the bag body 121. As the material quality of the sheet piece forming the lid material 122, there can be used a similar material quality to that of the sheet material forming the bag body 121.

The thickness of the sheet piece forming the lid material 122 is larger than the thickness of the sheet material forming the bag body 121 and 60 to 80 μm preferably.

The shape of lid material 122 is not particularly limited as long as the lid material 122 can completely cover the takeout port 121*a*, and the lid material 122 can have an arbitrary shape such as a rectangle and an oval, for example.

A pressure sensitive adhesive of polyester series, acrylic series, rubber series, or the like is applied to the back surface of the lid material 122, and the lid material 122 is bonded to the bag body 121 so as to cover the takeout port 121*a* to be openable and closable.

The lid material 122 has one end portion fixed to the bag body 121 and has the other end portion provided with a tab 122*a* protruding from the end portion as shown in FIG. 1A, and only the lower surface of the tab 122*a* does not have the pressure sensitive adhesive applied. Thus, the lid material 122 is opened and closed easily by using the tab 122*a*.

{Production Method}

Next, an example of the production method for the wet-sheet package 100 according to the embodiment will be described.

(Step 1: Folding Step)

First, in the base material sheet of each wet sheet, the portion around the first edge 111*a* is folded toward the first surface 111*c* side to form the fourth fold 111*h*, and thereafter the base material sheet is folded toward the second surface 111*d* side at the position having a predetermined interval in a direction to the second edge 111*b* from the fourth fold 111*h* to form the second fold 111*f*.

Furthermore, the portions of the base material sheet overlapping due to the folding at the second fold 111*f* are folded to the opposite side to the fourth fold 111*h* while maintaining the overlapping state, to form the first fold 111*e* and the third fold 111*g* together.

Thereby, the base material sheet of each wet sheet 111 can be folded as shown in FIG. 2.

(Step 2: Chemical Solution Impregnating Step)

The base material sheet which was folded in step 1 is then impregnated with a chemical solution.

At this time, the base material sheet is impregnated with the chemical solution by using a chemical solution applying nozzle, for example. To be specific, the base material sheet is impregnated with the chemical solution by moving and passing the base material sheet under the chemical solution applying nozzle, which is arranged to extend in the direction orthogonal to the folds formed in the base material sheet, in the direction orthogonal to the extending direction of the chemical solution applying nozzle (direction parallel to the folds formed in the base material sheet).

This chemical solution applying nozzle is provided with multiple fine ejection holes for ejecting the chemical solution downward. By forming the portion provided with such ejection holes at only the positions matching the impregnated portions W of the wet sheet 111 in the direction orthogonal to the moving direction of the base material sheet, it is possible to form the multiple impregnated portions W and the non-impregnated portions D in a stripe pattern alternately arranging the impregnated portions W and the non-impregnated portions D in the base material sheet which passed under the chemical solution applying nozzle.

The impregnating method with the chemical solution is not limited to the method of ejecting the chemical solution from a nozzle as descried above, and roll transfer may be performed by using the roll applying the chemical solution with a pattern matching the impregnated portions W and the non-impregnated portions D in the wet sheet 111, for example.

(Step 3: Stacking Step)

Multiple wet sheets 111 each of which was formed by being impregnated with the chemical solution after folding the base material sheet are stacked such that the second surfaces 111*d* in the main portions 111*i* are directed upward.

To be specific, as shown in FIG. 4, the wet-sheet laminated body 110 is formed by stacking a predetermined number of wet sheets 111 in such a way that the wet sheets 111 arranged with the first edge 111*a* side and the second edge 111*b* side directed opposite to each other are stacked alternately, and the portion of the main portion 111*i* around the second edge 111*b* of each of the wet sheets 111 except for the uppermost wet sheet 111 is sandwiched between the first folded-back portion 111*j* and the main portion 111*i* of the wet sheet 111 immediately above the wet sheet 111.

(Step 4: Packaging Step)

The wet-sheet laminated body 110 which was formed is wrapped in the sheet material forming the bag body 121 of the package 120, portions of the sheet material are then bonded along the long direction of the bag body 121 on the bottom surface side of the bag body 121 to form the center seal portion 121*b* and the end portions in the long direction of the bag body 121 are connected to form the end seal portions 121*c*, 121*c*, and thereby the wet-sheet laminated body 110 is contained in the bag body 121.

Thereafter, the lid material 122 is attached so as to cover the takeout port 121*a* of the bag body 121.

Effects of Embodiment

By the wet-sheet package 100 according to the embodiment, as shown in FIGS. 2 and 3, each of the wet sheets 111 forming the wet-sheet laminated body 110 is formed to have the multiple impregnated portions W and the multiple non-impregnated portions D in a stripe pattern in a plan view of the wet-sheet laminated body 110, and the wet sheets 111 are stacked.

When the wet sheets are stacked, hydrogen bond of the chemical solution between upper and lower wet sheets strongly attach the wet sheets to each other, which causes a string of the wet sheets to be taken out. According to the present embodiment, it is possible to weaken such attachment between the upper and lower wet sheets and reduce the possibility that a string of the wet sheets is taken out.

Even in providing a same area of non-impregnated portion(s), when a single impregnated portion has a wide area in a plan view of the wet-sheet laminated body, for example, when the impregnated portion and the non-impregnated portion are provided by dividing the wet sheet into two, wet sheets strongly attach to each other on the impregnated portions, and it is not possible to sufficiently prevent the string of wet sheets in some cases.

With respect to this, according to the present embodiment, by arranging the multiple impregnated portions and the multiple non-impregnated portions in a stripe pattern in a plan view of the wet-sheet laminated body 110, it is possible to weaken the attachment between wet sheets nearly uniformly for the entire surface, and enhance the effect of preventing the string of wet sheets.

As shown in FIG. 4, the effect of preventing the string of wet sheets can be enhanced most when the wet sheets 111 are stacked such that the impregnated portions W in each of the wet sheets 111 do not overlap in a plan view with the impregnated portions W in the wet sheets 111 located immediately above and below the wet sheet 111 and the impregnated portions W are alternately arranged in a staggered manner, since there is no portion where the impregnated portions W contact the impregnated portions W of the wet sheets 111 located immediately above and below the wet sheet 111.

However, the configuration which can obtain the effect of preventing the string of wet sheets is not limited to the staggered arrangement.

First, when the wet sheets 111 are stacked such that the impregnated portions W in each of the wet sheets 111 are arranged at positions shifted from the positions of impregnated portions W in the wet sheets 111 located immediately above and below the wet sheet 111 and both of the overlapping portions and the non-overlapping portions in a plan view are generated, though there are portions where the impregnated portions W contact each other, the contacting area is narrow and at the same time there are formed portions where the non-impregnated portions D contact each other and portions where the non-impregnated portions D and the impregnated portions W contact each other. Thus, compared with a case where the entire wet sheet 111 is impregnated with the chemical solution, the attachment between wet sheets 111 can be weakened, and it is possible to obtain a sufficient effect though the effect is inferior to the effect of the case arranging the impregnated portions W and the non-impregnated portions D in a staggered manner.

Moreover, even when the wet sheets 111 are stacked such that the impregnated portions W in each of the wet sheets 111 are at substantially same positions in a plan view with the impregnated portions W in the wet sheets 111 located immediately above and below the wet sheet 111, though there are portions where the impregnated portions W contact each other, at the same time, there are also formed portions where the non-impregnated portions D contact each other. Thus, compared with a case where the entire wet sheet 111 is impregnated with the chemical solution, the attachment between wet sheets 111 can be weakened, and it is possible to obtain a certain effect though the effect is inferior to the effect of the case arranging the impregnated portions W at positions shifted from the impregnated portions W in the wet sheets 111 located immediately above and below the wet sheet 111.

In the wet-sheet package 100 according to the embodiment, as shown in FIG. 4, in each portion where upper and lower wet sheets 111 overlap, the portion around the second edge 111*b* of the main portion 111*i* of the lower wet sheet 111 is sandwiched between: the main portion 111*i*, the third folded-back portion 111*l* and the fourth folded-back portion 111*m*; and the first folded-back portion 111*j* and the second folded-back portion 111*k* in the upper wet sheet 111, and the sheets overlap in six layers.

This increases the resistance that is applied when the main portion 111*i* is nipped and the wet sheet 111 is pulled out from around the second edge 111*b* by using the takeout port 121*a* of the package 120, and the wet sheet 111 is not taken out unless a large force is applied. Thus, it is possible to further reduce the possibility that, when one wet sheet 111 is taken out, the wet sheet 111 immediately below the one wet sheet 111 is taken out in the form of a string of the wet sheets 111.

This effect is enhanced by forming the fourth fold 111*h* and the fourth folded-back portion 111*m*. However, even when these are not provided, it is possible to obtain a certain effect since five layers of the sheet material overlap.

When one wet sheet 111 is pulled out through the takeout port 121*a* of the package 120, a large resistance is applied to the above overlapping portions, opening the first fold 111*e* and the third fold 111*g*, and increasing the gap between the main portion 111*i* and the first folded-back portion 111*j*. This releases the portion around the second edge 111*b* of the main portion 111*i* of the next wet sheet 111 which is sandwiched between the main portion 111*i* and the first folded-back portion 111*j*, and the next sheet easily comes off.

Accordingly, also from this respect, it is possible to reduce the possibility that, when one wet sheet 111 is taken out, the wet sheet 111 immediately below the wet sheet 111 is taken out in the form of a string of the wet sheets 111.

In the wet-sheet package 100 according to the embodiment, when the wet sheet 111 is pulled out through the takeout port 121*a* of the package 120 by nipping the main portion 111*i*, the second fold 111*f* is difficult to open. Thus, the wet sheet 111 is taken out while maintaining the state in which the portion around the first edge 111*a* is folded at the second fold 111*f*.

In conventional wet sheets folded in a Z shape, since the wet sheet 111 is taken out in a state in which the entire wet sheet 111 is unfolded, the portion around the end opposite to the portion nipped by the user when the wet sheet 111 is taken out easily stretches by the resistance at the time of taking out. However, according to the present embodiment, it is possible to reduce such a possibility since the wet sheet 111 is taken out while maintaining the portion around the end folded.

Modification Examples

Though the above embodiment has been described for a case where a wet-sheet laminated body is obtained by folding base material sheets and then impregnating the base material sheets with a chemical solution, and thereafter stacking the wet sheets, the production method for the wet-sheet laminated body is not limited to this.

The wet-sheet laminated body may be obtained by first impregnating the base material sheets with a chemical solution in a stripe pattern, then folding the base material sheets by the folding manner shown in FIG. 2, and thereafter stacking the wet sheets by the stacking method shown in FIG. 4.

The wet-sheet laminated body can be obtained by folding base material sheets by the folding manner shown in FIG. 2, thereafter stacking the folded base material sheets by the stacking method shown in FIG. 4, and after obtaining the laminated body, impregnating the laminated body with a chemical solution.

However, this case is not desirable since there can be formed only the wet-sheet laminated body stacking wet sheets such that the impregnated portions W in each of the wet sheets are at substantially same positions in a plan view as the impregnated portions W in the wet sheets located immediately above and below the wet sheet 111, and when the number of wet sheets forming the wet-sheet laminated body is large and the wet-sheet laminated body is thick in the up-down direction, there is a possibility that the stripe pattern formed by the impregnated portions W and the non-impregnated portions D is not clear in the wet sheets at lower positions away from the upper surface to which the chemical solution is applied.

The above embodiment has been described for a case where the wet sheets 111 are formed such that the impregnated portions W and the non-impregnated portions D form a stripe pattern along the direction (Y direction in FIGS. 2 and 3) parallel to the folds and are alternately arranged in the direction (X direction in FIGS. 2 and 3) orthogonal to the folds. However, the configuration is not limited to this. For example, contrary to above, the wet sheet 111 may be formed such that the impregnated portions W and the non-impregnated portions D form a stripe pattern along the direction (X direction in FIGS. 2 and 3) orthogonal to the folds and alternately arranged in the direction (Y direction in FIGS. 2 and 3) parallel to the folds. The wet sheet 111 can also be formed such that the stripe pattern is oblique to the folds of the wet sheet.

However, from the viewpoint of easiness of production, it is preferable that the impregnated portions W and the non-impregnated portions D form a stripe pattern along the direction (Y direction in FIGS. 2 and 3) parallel to the folds of the wet sheet.

The above embodiment has been described for a case where each of the wet sheets 111 is folded by the folding manner shown in FIG. 2, and these wet sheets 111 are stacked by the stacking method shown in FIG. 4. However, the specific folding manner of wet sheets and the stacking method thereof are not limited to this.

Figure 5:
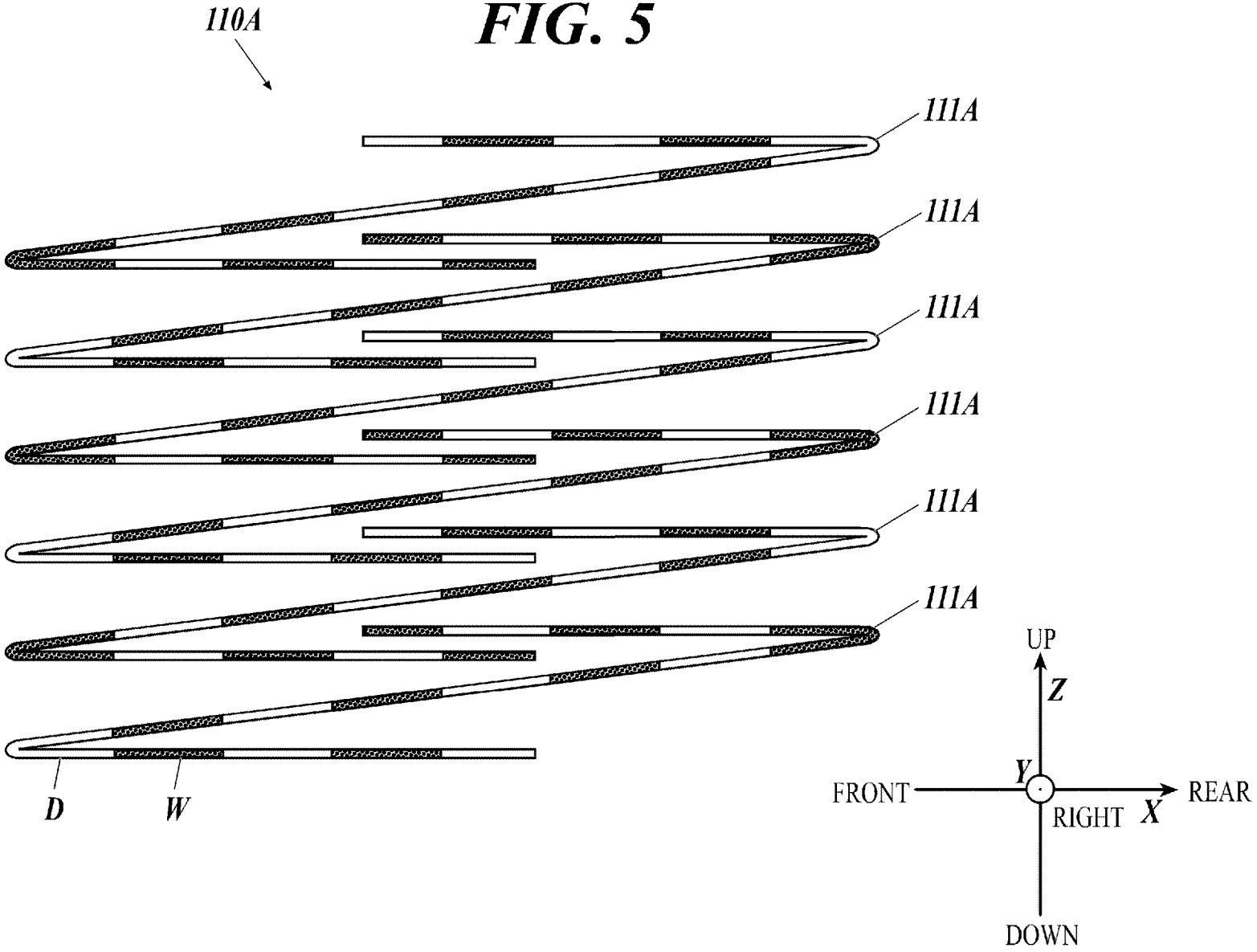
FIG. 5 is a lateral view of a wet-sheet laminated body according to a modification example. The interval between folded sheets and interval between stacked sheets are shown to be larger than the real intervals. The number of stacked sheets is shown to be smaller than the real number of stacked sheets.

For example, in a wet-sheet laminated body 110A which is formed by stacking wet sheets 111A folded in a Z shape as in a conventional way such that the wet sheets 111A partially overlap as shown in FIG. 5, it is similarly possible to obtain the effect caused by providing the impregnated portions W and the non-impregnated portions D to be alternately arranged in a stripe pattern in a plan view of the wet-sheet laminated body 110A.

Also in this case, as shown in FIG. 5, it is preferable that the impregnated portions W in each of the wet sheets 111A do not overlap in a plan view with the impregnated portions W in the wet sheets 111A located immediately above and below the wet sheet 111A, and alternately arranged in a staggered manner, and it is preferable to arrange a stripe pattern along the direction (Y direction in FIG. 5) parallel to the folds in the wet sheet 111A, though the configuration is not limited to them.

However, in order to more enhance the effect of preventing a string of wet sheets 111 from being taken out, it is most preferable to fold each of the wet sheets 111 by the folding manner shown in FIG. 2, and to stack the wet sheets 111 in the stacking method shown in FIG. 4.

EXAMPLES

Next, for wet-sheet packages according to examples of the present invention and a comparative example, description will be made for the results of measuring the sticking force between wet sheets and performing tests regarding the probability that a string of wet sheets are taken out at the time of taking out a wet sheet.

Configurations of Examples and Comparative Example

The following wet-sheet packages according to the examples and the comparative example were prepared.

Example 1

(Wet-Sheet Laminated Body)

<Configuration of Base Material Sheet>

Size: Rectangle of 135 mm in MD direction, 175 mm in CD direction

Fiber material: Rayon 50 mass %, PET (polyethylene terephthalate) 50 mass %

Production method: Spun-lace nonwoven fabric

Basis weight: 30 gsm

<Configuration of Chemical Solution>

Components: Purified water 99 mass % or more, preservatives (benzoic acid, phenoxyethanol, etc.) less than 1 mass %

Chemical solution impregnation rate: 230%

<Stacking and Impregnating Methods>

The base material sheet was folded by the folding manner shown in FIG. 2 such that the first fold 111*e*, the second fold 111*f*, the third fold 111*g* and the fourth fold 111*h* are formed by the folds parallel to the MD direction, and the main portion 111*i* has the width of 75 mm in the CD direction, the first folded-back portion 111*j* has the width of 30 mm in the CD direction, the second folded-back portion 111*k* has the width of 30 mm in the CD direction, the third folded-back portion 111*l* has the width of 35 mm in the CD direction, and the fourth folded-back portion 111*m* has the width of 5 mm in the CD direction.

The base material sheet folded in such a way was impregnated with a chemical solution in a stripe pattern which is parallel to the MD direction and alternately arranging the impregnated portions W and non-impregnated portions D in the CD direction.

To be specific, the base material sheet was impregnated with the chemical solution such that, in a plan view of the base material sheet in the folded state, the stripe pattern forms three impregnated portions W with the width of approximately 12.5 mm (12 to 13 mm) in the CD direction and three non-impregnated portions D with the width of approximately 12.5 mm (12 to 13 mm) in the CD direction, and the end of the base material sheet on the side where the second edge 111*b* is formed is the impregnated portion W. In this case, in the unfolded state of the base material sheet, seven impregnated portions W are formed in the CD direction and seven non-impregnated portions D are formed in the CD direction.

As shown in FIG. 4, 80 sheets of such wet sheets 111 were stacked in such a way that the portion around the second edge 111*b* of the main portion 111*i* of the wet sheet 111 located below is sandwiched by the width of 20 mm in the CD direction between the first folded-back portion 111*j* and the main portion 111*i* of the wet sheet 111 immediately above the wet sheet 111.

The wet sheets 111 were stacked such that the impregnated portions W in each of the wet sheets 111 are arranged at positions shifted from the impregnated portions W of the wet sheets 111 located immediately above and below the wet sheet 111, and both of portions where the impregnated portions W overlap in a plan view and portions where the impregnated portions W do not overlap are generated.

<Stretch of Sheet>

The stretch of the wet sheet when the force of 1.5 N was applied by the method described in paragraph 0030 was 71.6 mm.

(Package)

<Bag Body>

Sheet material: Material PET/LLDPE, thickness 62 μm

Shape: Pillow package type shown in FIGS. 1A and 1B

Size: Perimeter is 360 mm on the inner surface side in the cross section (cross section along the YZ plane in FIGS. 1A and 1B) in the long direction in a plan view excluding end seal portions 121*c*, 121*c*, and perimeter is 260 mm on the inner surface side in the cross section (cross section along the XZ plane in FIGS. 1A and 1B) in the short direction in a plan view Takeout port: Oval with a long diameter of 35 mm and a short diameter of 15 mm. The takeout port was formed in the center of the upper surface of the bag body. The takeout port in a released state was used by peeling the lid material.

Example 2

The stretch of the wet sheet when the force of 1.5 N was applied by the method described in paragraph 0030 was made 101.0 mm.

The stretch of wet sheet was made larger than the stretch of Example 1 by weakening the water pressure at the time of forming the spun-lace nonwoven fabric and weakening the compression of base material sheet without changing the compounding of fiber materials forming the base material sheet from the Example 1.

The other configurations are similar to those of Example 1.

Comparative Example 1

The entire base material sheet was impregnated with the chemical solution uniformly. The pattern of impregnation was changed from the stripe pattern to an overall uniform pattern, and the chemical solution impregnation rate was 230% similarly to Example 1.

The other configurations are similar to those of Example 1.

[Test Method]

The following test was performed by using the wet-sheet packages according to the above examples and comparative example.

{Measurement of Sticking Force Between Sheets}

The sticking force between wet sheets was measured for the wet-sheet packages of the above examples and comparative example.

To be specific, the wet-sheet laminated body was taken out from the package, a digital force gauge (IMADA, DS2-200N) was then connected to the portion of wet sheet 111 overlapping with the takeout port 121*a* in a plan view when packaged in the package, the wet sheet 111 was tensioned in a vertical direction in this state, the maximum value of the force which was applied when the wet sheet 111 was peeled from the sheet immediately below the wet sheet 111 was measured for the 1st sheet to the 79th sheet, and the average value thereof was obtained.

{Test Regarding Probability of String of Sheets Taken Out on Taking Out of Sheet}

As for the wet-sheet packages used in the above examples and comparative example, multiple wet sheets were consecutively taken out, and the probability that a string of sheets was taken out upon the taking out of sheet was calculated.

To be specific, the wet sheets were pulled out one by one while pressing, with one hand, the portion around the one end in the long direction in a plan view in such a way that the portion is sandwiched from both sides in the short direction in a plan view (thumb contacts one lateral surface, middle finger and index finger contact the other lateral surface facing the one lateral surface, and these fingers sandwich the portion) without suppressing the upper surface in each of the sheet packages.

To be specific, from the state in which the 80 wet sheets were contained, all of the 80 sheets were pulled out one by one.

When one sheet was taken out and the sheet below the one sheet came out connected with the one sheet and the second sheet was completely taken out from the package, it was determined that a string of sheets was taken out, and the number of such sheets was counted.

The test was performed twice, and the average was obtained as the number of sheets which were taken out in the form of a string of sheets. Accordingly, for example, when the first time was one sheet and the second time was zero, the number of sheets which were taken out in the form of a string of sheets is 0.5.

[Test Results]

The test results are shown in Table 1.

TABLE 1

| | Example 1 | Example 2 | Comparative Example 1 |
|---|---|---|---|
| Sticking Force between Sheets (N) | 1.1 | — | 1.5 |
| Number of Sheets Taken out as String of Sheets (sheet) | 9 | 18 | 28 |
| Probability of String of Sheets Taken Out (%) | 11.3 | 22.5 | 35.0 |

[Evaluation]

The comparison between Example 1 and Comparative Example 1 shows that the sticking force between sheets is weakened by forming a wet-sheet laminated body with wet sheets impregnated with a chemical solution in such a stripe pattern that multiple impregnated portions W and multiple non-impregnated portions D are alternately arranged in a plan view of the wet-sheet laminated body, compared with a case where the wet-sheet laminated body is formed with wet sheets in each of which the entire sheet was uniformly impregnated with the chemical solution.

Accordingly, when one sheet is pulled out, the force of the sheet below the one sheet sticking to and pulled by the sheet that is pulled out is weakened, which makes it difficult for a string of the sheets to be pulled out.

The actual pull-out test also shows that it is possible to reduce the probability of a string of wet sheets being taken out by forming the wet-sheet laminated body with wet sheets which were impregnated with a chemical solution in such a stripe pattern that multiple impregnated portions W and multiple non-impregnated portions D are alternately arranged in a plan view of the wet-sheet laminated body, compared with a case where the wet-sheet laminated body is formed by wet sheets in each of which the entire sheet is uniformly impregnated with the chemical solution.

The comparison between Examples 1 and 2 shows that it is possible to reduce the probability of a string of wet sheets being taken out by forming a wet-sheet laminated body with wet sheets each of which stretches by 100 mm or less when the force of 1.5 N was applied by the method described in paragraph 0030.

The present invention is suitably applied in a technical field of producing a wet-sheet laminated body and a wet-sheet package.

The invention claimed is:

1. A wet-sheet laminated body comprising:

a plurality of folded wet sheets that are stacked such that an end portion of one wet sheet among the plurality of folded wet sheets, except for an uppermost wet sheet, is sandwiched between a main portion and a folded-back portion of another wet sheet among the plurality of folded wet sheets, wherein each wet sheet of the plurality of folded wet sheets comprises a base material sheet impregnated with a chemical solution such that multiple impregnated portions that are impregnated with the chemical solution and multiple non-impregnated portions that are not impregnated with the chemical solution are provided in each of the plurality of folded wet sheets, the impregnated portions and the non-impregnated portions are formed in a stripe pattern in which the impregnated portions and the non-impregnated portions are alternately arranged and the stripe pattern of the impregnated portions and the non-impregnated portions is parallel to a fold of each wet sheet in a plan view of the wet-sheet laminated body.

2. The wet-sheet laminated body of claim 1, wherein a width of the end portion sandwiched between the main portion and the folded-back portion of another wet sheet is between 5% and 35% of a width of the main portion.

3. A wet-sheet package comprising:

the wet-sheet laminated body according to claim 1; and a package which includes a takeout port and in which the wet-sheet laminated body is contained.

4. The wet-sheet laminated body according to claim 1, wherein each of the wet sheets has a rectangular shape, wherein each of the wet sheets is folded such that: the wet sheet is folded back to a first surface side thereof at a first fold that is substantially parallel to a first edge of the wet sheet, the wet sheet is folded back to a second surface side thereof at a second fold that is formed between the first fold and the first edge and is substantially parallel to the first edge, the wet sheet is folded back to the second surface side thereof so as to wrap around an outer circumference of the first fold at a third fold that is formed between the second fold and the first edge and is substantially parallel to the first edge, and wherein the wet sheets are stacked such that: the second surface side of each of the sheets is directed upward in a portion of the sheet between the first fold and a second edge facing the first edge, and the another wet sheet is located above the one wet sheet in such a way that the second edge of the one wet sheet is sandwiched between a portion between the first fold and the second fold of the another wet sheet and a portion between the first fold and the second edge of the another wet sheet.

5. The wet-sheet laminated body according to claim 1, wherein the impregnated portions and the non-impregnated portions are arranged at shifted positions in a plan view in the one wet sheet and in the another wet sheet, which is arranged immediately above the one wet sheet.

6. The wet-sheet laminated body according to claim 5, wherein the impregnated portions and the non-impregnated portions are arranged in a staggered manner in the one wet sheet and in the another wet sheet.

7. A production method for a wet-sheet laminated body, the production method comprising:

folding a base material sheet;

impregnating the folded base material sheet with a chemical solution to form multiple impregnated portions impregnated with the chemical solution and multiple non-impregnated portions not impregnated with the chemical solution in a stripe pattern in which the impregnated portions and the non-impregnated portions are alternately arranged, wherein the stripe pattern of the impregnated portions and the non-impregnated portions is parallel to a fold of each wet sheet in a plan view of the wet-sheet laminated body; and stacking multiple base material sheets each of which is the base material sheet impregnated with the chemical solution.

8. A production method for a wet-sheet laminated body, the production method comprising:

impregnating a base material sheet with a chemical solution to form multiple impregnated portions impregnated with the chemical solution and multiple non-impregnated portions not impregnated with the chemical solution in a stripe pattern in which the impregnated portions and the non-impregnated portions are alternately arranged, wherein the stripe pattern of the impregnated portions and the non-impregnated portions is parallel to a fold of each wet sheet in a plan view of the wet-sheet laminated body;

folding the base material sheet impregnated with the chemical solution; and stacking base material sheets each of which is the folded base material sheet.

* * * * *